United States Patent [19]

Barone

[11] 4,070,079

[45] Jan. 24, 1978

[54] LAMP SOCKET AND CLAMPING DEVICE

[76] Inventor: Anthony Barone, 225-27 112th Road, Queens Village, N.Y. 11429

[21] Appl. No.: 726,646

[22] Filed: Sept. 27, 1976

[51] Int. Cl.[2] ..... H01R 13/54

[52] U.S. Cl. ..... 339/91 L; 339/61 L; 339/90 F; 339/144 R

[58] Field of Search ..... 313/318; 339/61 L, 88 R, 339/88 C, 90 R, 90 F, 91 L, 93 L, 188 R, 188 C, 144 R

[56] References Cited

U.S. PATENT DOCUMENTS 3,185,954 5/1965 Schade ..... 339/90 F

*Primary Examiner*—Roy Lake
*Assistant Examiner*—E. F. Desmond
*Attorney, Agent, or Firm*—Robert D. Farkas

[57] ABSTRACT

A flexible lamp socket utilizes a plate having a pair of spaced apart arms secured to the lamp. The free ends of the arms are directed towards each other and engage a pair of semi-annular grooves in the exterior cylindrical surface of the socket, disposing the terminal end of the lamp within a hole in the socket carrying electrical contacts. The assembly provides a removable lamp socket which minimized damage to the lamp due to vibration.

5 Claims, 3 Drawing Figures

LAMP SOCKET AND CLAMPING DEVICE

BACKGROUND OF THE INVENTION

1. Field of the Invention

This invention relates to lamp sockets and more particularly, to that class utilizing non screw-in type lamps.

2. Description of the Prior Art

The prior art abounds with rigid sockets adapted for use with flange or bayonet type lamps. Such sockets rigidly secure the lamp body to the socket and fail to provide a lamp mounting device which supports the lamp, maintains electrical contact therewith, in a flexible manner so as to minimize the effects of vibration.

SUMMARY OF THE INVENTION

A primary object of the present invention is to provide a lamp socket which mounts the lamp non-rigidly to the socket.

Another object is to provide a lamp socket which carries bayonet or straight shank lamps.

Still another object is to provde a lamp socket particularly useful in vehicles prone to vibration and shock.

Yet another object is to provide a lamp socket in accordance with the preceeding objects which is relatively inexpensive, easy to manufacture and suitable for its particular purposes.

Heretofore, the terminal end of lamps were rigidly clamped to a rigid lamp socket to insure secure mounting of the lamp to the socket and to insure adequate electrical contact to the terminals of the lamp. Lamp life was limited in those applications in which the socket was employed carried aboard vehicles due to the ability of the socket to transmit vibrations and shock forces experienced by the vehicle to the lamp. The present invention minimizes the effects of the vibrational and shock forces experienced by the vehicle as felt by the lamp due to the resilient nature of the body of the socket, whilst insuring that good electrical contact is made with the terminals of the lamp.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a cylindrical solid body of resilient rubber-like material having a hole disposed in one end of the cylinder of the body adapted to receive the terminal end of an incandescent lamp. At least two contacts reside within the hole abutting the walls thereof, communicating with wires elecrtrically fastened to the contacts to a power source utilized to energize the lamp. The body portion of the socket is fabricated from a resilient rubber-like material such as rubber or a closed cell foam plastic material such as polyurethane.

The body portion of the socket has a solid cylindrical shape and includes a pair of semi-annular grooves in the cylindrical surface disposed opposite each other and residing in a plane normal to the longitudinal axis of the body.

A non-screw in type incandescent lamp is utilized having a plate fixedly secured to the lamp at a point located intermediate the light emitting portion and the terminal portion of the lamp and extending radially outwardly therefrom. The plate is fastened to the lamp such as by the use of an adhesive joining the lamp to a hole passing through the plate. A pair of arms extend normal to the plate and are disposed in spaced apart relationship extending outwardly from the terminal portion of the lamp and are adapted to have the free ends thereof turned inwardly towards each other and towards the longitudinal axis of the lamp.

In use, the free ends of the arms are engaged within grooves causing the terminal end of the lamp to be positioned within the hole of the socket and to have the terminals affixed to the lamp disposed in touching electrical engagement with the socket contacts.

If desired, a pair of notches may be employed extending from the semi-annular grooves to the end of the socket body carrying the lamp-receiving hole. The notches facilitate the insertion of the free ends of the arms into the semi annular grooves by permitting the free ends of the arms to be forced to travel from the end of the socket carrying the hole towards the semi-annular grooves. Alternatively, when the notches are not employed, the socket body may be deformed, due to its resilient nature, permitting the free ends of the arms to snap into and out of the semi-annular grooves whilst inserting the lamp into or removing the lamp from a mounting position with the socket.

Figure 1:
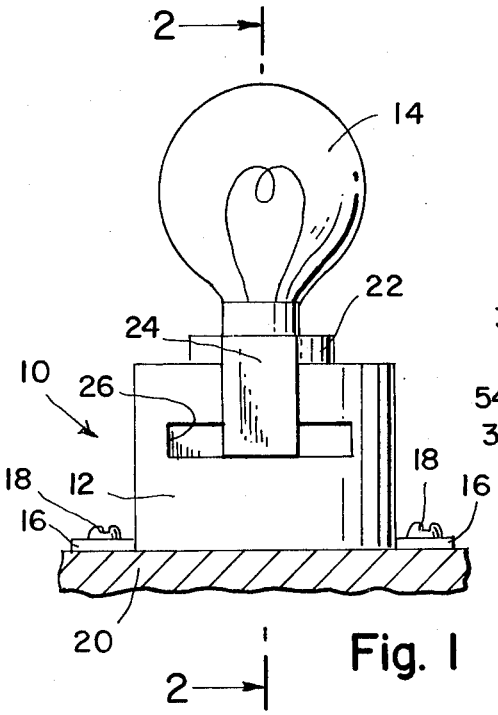
FIG. 1 is a side elevation view of the present invention.

Now referring to the Figures, and more particularly, to the embodiment illustrated in FIG. 1 showing the present invention 10 comprising a resilient cylindrical socket body 12 to which incandescent lamp 14 is mounted. The socket is provided with legs 16 utilizing bolts 18 to fasten to mounting surface 20. Plate 22 is secured to lamp 14 and is provided with leg 24 engaging semi-annular groove 26 disposed in the cylindrical surface of body 12.

Figure 2:
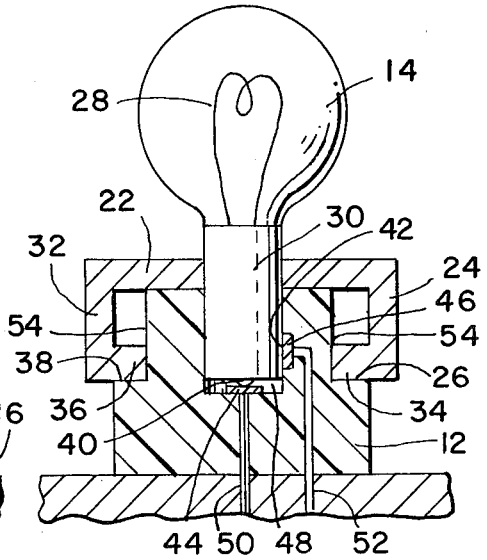
FIG. 2 is a side elevation cross-sectional view taken along line 2—2 viewed in the direction of arrows 2—2 as shown in FIG. 1.

FIG. 2 illustrates lamp 14 having a light emitting portion 28 and terminal carrying portion 30. Plate 22 is secured to portion 30 of the lamp and is provided with arms 24 and 32 extending downwardly and outwardly from portion 30 of lamp 14. Free ends 34 and 36 of arms 24 and 32 respectively reside in semi-annular grooves 26 and 38 respectively, causing terminal 40 and terminal 42 of lamp 14 to electrically contact contacts 44 and 46 residing within hole 48 located at one end of body 12. Wires 50 and 52 communicate electrically with contacts 44 and 46 respectively and provide power for lamp 14 when energized. Lines 54 define vertically disposed notches in the cylindrical surface of body 12 facilitating the easy downward insertion of ends 34 and 36 of arms 24 and 32 into semi-annular grooves 26 and 38. A twisting motion exerted on plate 22 permits free ends 34 and 36 to be locked within grooves 26 and 38. The resilient characteristics of body 12 permit contacts 44 and 46 to clampingly electrically engage terminals 40 and 42 of lamp 14.

Figure 3:
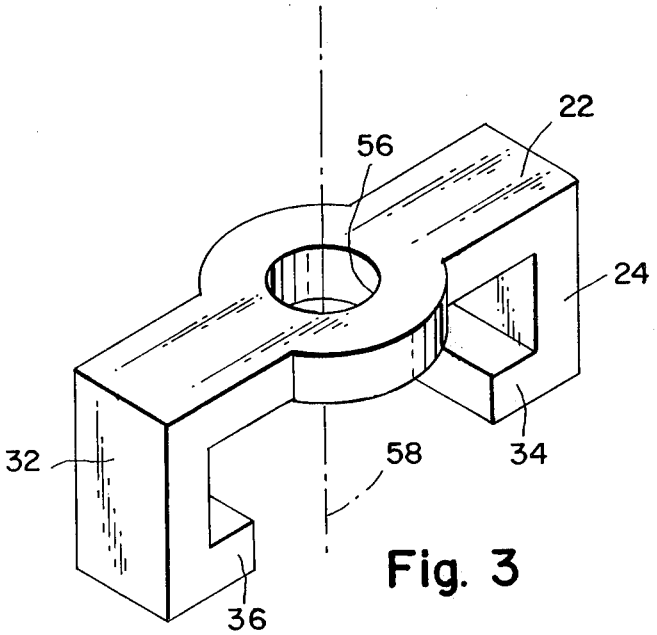
FIG. 3 is a perspective view of the lamp engaging element of the present invention.

FIG. 3 illustrates rigid plate 22 having hole 56 therein adapted to receive portion 30 of lamp 14, as shown in FIG. 2. Rigid arms 24 and 32 extend parallel to the longitudinal axis 58 of hole 56 which is disposed normal to the lateral surfaces of plate 22. Free ends 34 and 36 of arms 24 and 32 respectively are directed towards each other and are opposite one another so as to form a pair of hook-like ends residing in a common plane normal to longitudinal axis 58 and adapted to be inserted into semi-annular grooves 26 and 38 of body 12 as shown in FIG. 2.

One of the advantages is to provide a lamp socket which mounts the lamp non-rigidly to the socket.

Another advantage is to provide a lamp socket which carries bayonet or straight shank lamps.

Still another advantage is to provide a lamp socket particularly useful in vehicles prone to vibration and shock.

Yet another advantage is to provide a lamp socket in accordance with the preceeding objects which is relatively inexpensive, easy to manufacture and suitable for its particular purposes.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appended claims.

I claim :

1. A lamp socket and clamping device comprising a resilient rubber like cylindrical block having a whole located at one end thereof, the longitudinal axis of the hole being co-axially aligned with the longitudinal axis of the block, at least a pair of electrical contacts being within the hole, the exterior cylindrical surface of the block having a pair of semi-annular grooves therewithin, the pair of grooves defining a plane, the plane extending normal to the longitudinal axis of the block, a plate fixedly secured to a lamp and extending radially outwardly therfrom, a pair of arms fixedly secured to the plate, the lamp having a light emitting portion and a terminal portion, the plate being located intermediate the light emitting portion and the terminal portion of the lamp, the pair of arms extending normal to the plate and parallel to and outwardly from the terminal portion of the lamp, the free end of each of the pair of arms being directed towards one another and extending substantially parallel to the plate, the free ends of the arms being captured within the semi-annular grooves and at least the pair of electrical contacts in touching electrical engagement with the terminal portion of the lamp.

2. The lamp socket and clamping device as claimed in claim 1 further comprising a notch in the exterior cylindrical surface of the block, the notch extending from one of the semi-annular grooves to said one end of the block, the longitudinal axis of the notch extending parallel to the longitudinal axis of the block.

3. The lamp socket and clamping device as claimed in claim 1, wherein said cylindrical block comprises rubber.

4. The lamp socket and clamping device as claimed in claim 1, wherein said cylindrical block comprises a closed cell foamed plastic material.

5. The lamp socket and clamping device as claimed in claim 4, wherein said plastic material comprises polyurethane.

* * * * *